US006617487B2

(12) United States Patent
Chou

(10) Patent No.: US 6,617,487 B2
(45) Date of Patent: Sep. 9, 2003

(54) WATER ABSORBABLE CLOTH MEMBER FOR SURGICAL OPERATION PURPOSES

(76) Inventor: Su Jen Chou, No. 19, Lane 221, Don Pin Road, Ho Mei Town, Chang Hua (TW), 508

( * ) Notice: Subject to any disclaimer, the term of this patent is extended or adjusted under 35 U.S.C. 154(b) by 0 days.

(21) Appl. No.: 09/929,657

(22) Filed: Aug. 15, 2001

(65) Prior Publication Data

US 2003/0036738 A1 Feb. 20, 2003

(51) Int. Cl.[7] ..... A61F 5/00; A41B 13/00; D04B 35/32

(52) U.S. Cl. ..... 602/56; 2/49.1; 66/170

(58) Field of Search ..... 604/317, 378; 2/49.1, 114, 901; 602/41, 56, 79; 128/849, 892, 893

(56) References Cited

U.S. PATENT DOCUMENTS 4,542,739 A * 9/1985 Schafer et al. ..... 602/44
4,901,714 A * 2/1990 Jensen ..... 602/41
5,490,289 A * 2/1996 Lehrer ..... 2/46
5,802,610 A * 9/1998 Burr ..... 156/73.1

* cited by examiner

*Primary Examiner*—Weilun Lo
*Assistant Examiner*—Linh Truong
(74) *Attorney, Agent, or Firm*—Charles E. Baxley

(57) ABSTRACT

A cloth member for use in surgical operations includes a fluid absorbing device attached on a base member for absorbing the fluid or the water or the blood or the other fluid substances generated during the surgical operations that may contain various kinds of germs. The fluid absorbing device includes a water-proof layer attached to the base member, and a cover layer and one or more intermediate layers attached to the water-proof layer for absorbing the fluid. The cover layer includes a number of hairy members formed for spoiling a surface tension of the fluid.

8 Claims, 6 Drawing Sheets

WATER ABSORBABLE CLOTH MEMBER FOR SURGICAL OPERATION PURPOSES

BACKGROUND OF THE INVENTION

1. Field of the Invention

The present invention relates to a cloth member, and more particularly to a cloth member having a water absorbing configuration for use in surgical operations and for absorbing the water and/or the blood and/or the other fluid substances generated during the surgical operations.

2. Description of the Prior Art

Typical cloth members for surgical operation purposes are spread on the bed or attached onto the patients' bodies or the doctors' bodies. Some of the cloth members may be used for absorbing the water and/or the blood and/or the other fluid substances generated during the surgical operations, but have no water-proof characteristics, such that the cushions of the beds and/or the doctors may be wetted by the water and/or the blood and/or the other fluid substances generated that are absorbed by the cloth members. The other cloth members may be made of water-proof materials, but may not be used to absorb the water and/or the blood and/or the other fluid substances generated during the surgical operations.

The present invention has arisen to mitigate and/or obviate the afore-described disadvantages of the conventional cloth members for surgical operations.

SUMMARY OF THE INVENTION

The primary objective of the present invention is to provide a cloth member including a water absorbing configuration for use in surgical operations and for absorbing the water and/or the blood and/or the other fluid substances generated during the surgical operations.

In accordance with one aspect of the invention, there is provided a cloth member for use in surgical operations, the cloth member comprising a base member, and a fluid absorbing device attached onto the base member for absorbing a fluid, the fluid absorbing device including a water-proof layer attached to the base member, and a cover layer attached to the water-proof layer for absorbing the fluid. The water and/or the blood and/or the other fluid substances generated during the surgical operations may contain various kinds of dirt and/or germs or the like, and may be prevented from being contacted with the users by the water-proof layer. The workers or the nurses for treating the cloth member, or the patients or the doctors who wear the cloth member thus will not be contacted with or may be prevented from contacting with the water and/or the blood and/or the other fluid substances generated during the surgical operations.

The cover layer includes a base sheet element, and includes a plurality of wale stitches and a plurality of course stitches and a plurality of repeat stitches formed on the base sheet element and engaged with each other for forming the cover layer.

The base sheet member of the cover layer includes a plurality of hairy members formed thereon for spoiling a surface tension of the fluid. The wale stitches and the course stitches and the repeat stitches of the cover layer each includes a plurality of hairy members formed thereon for spoiling a surface tension of the fluid. The cover layer includes at least one thread stitched thereon and having a plurality of hairy members formed thereon for spoiling a surface tension of the fluid.

One or more intermediate layers are disposed between the cover layer and the water-proof layer of the fluid absorbing device. The intermediate layer includes a base sheet element, and includes a plurality of wale stitches and a plurality of course stitches and a plurality of repeat stitches formed on the base sheet element and engaged with each other for forming the intermediate layer.

The intermediate layer is secured to the cover layer. The fluid absorbing device includes a chamber formed between the intermediate layer and the cover layer. The base member includes a depression formed therein for receiving the fluid absorbing device. The water-proof layer includes a peripheral flange engaged with and secured to the base member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
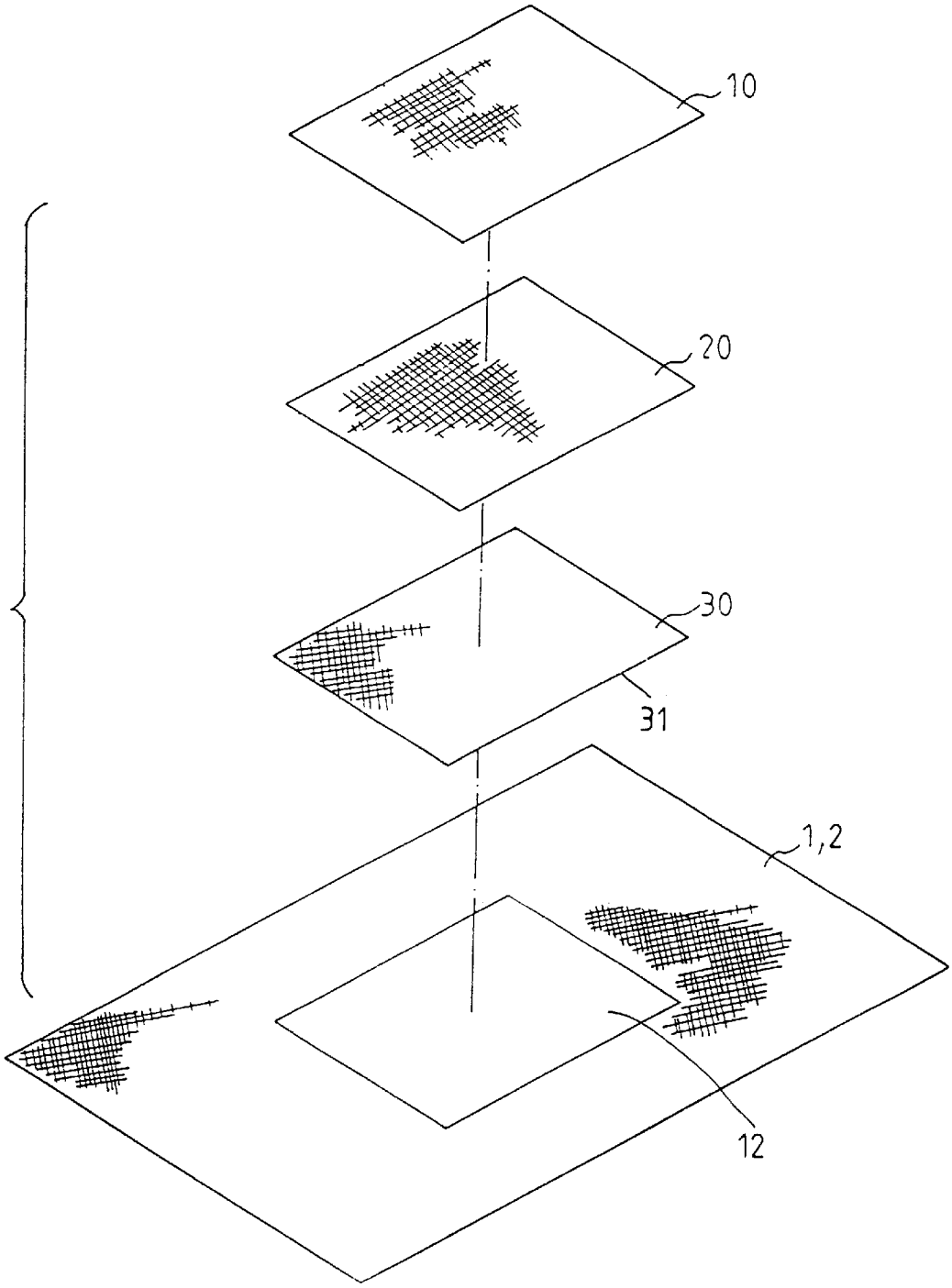
FIG. 2 is an exploded view of the cloth member.
Figure 7:
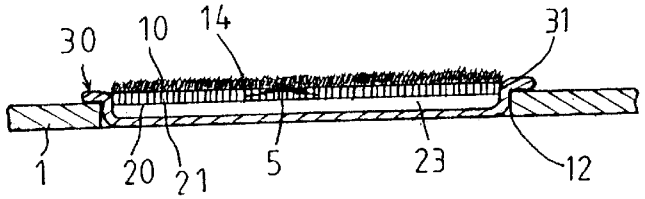
FIGS. 7 and 8 are cross sectional views similar to FIG. 6, illustrating the operation of the cloth member.
Figure 12:
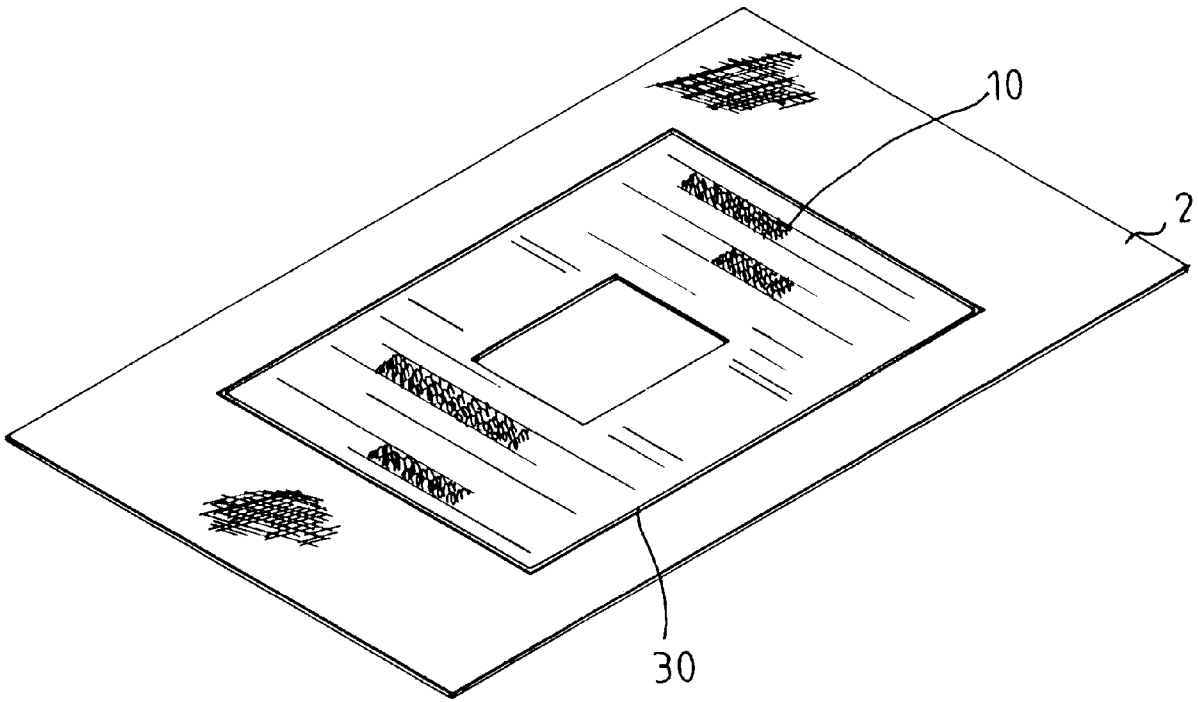
FIG. 12 is a perspective view illustrating the other application of the cloth member.

Referring to the drawings, and initially to FIGS. 1–6, a cloth member in accordance with the present invention comprises a base member 1 or 2 which may be a cloth sheet 2 as shown in FIGS. 2, 12 for spreading on the beds or the like, and/or which may be a cloth device 1 (FIGS. 1, 13–15) for attaching onto the patients' bodies or onto the doctors' bodies. The base member 1 or 2 includes a depression or an opening 12 formed therein for receiving a water absorbing device that includes one or more layers 10, 20 disposed on or in a bottom layer 30. The bottom layer 30 of the water absorbing device is made of water-proof materials and includes a peripheral flange 31 (FIGS. 6–8) engaged on the base member 1 or 2, and secured to the base member 1 or 2 with the stitch operations or with adhesive materials, or by the welding processes, or the like.

Figure 3:
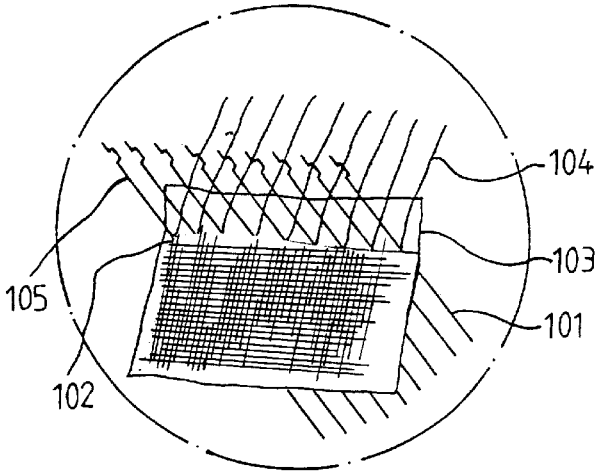
FIGS. 3, 4, 5 are enlarged partial perspective views illustrating the layers of the cloth member.
Figure 4:
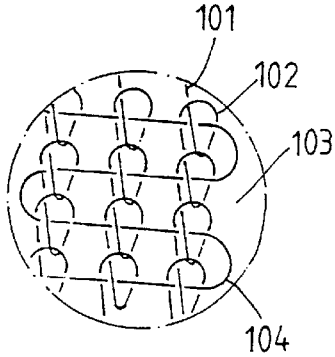

The outer layer 10 and one or more intermediate layers 20 may be formed by a warp knitting operation or a warp stitching operation which will be described hereinafter. As shown in FIGS. 3 and 4, one or more threads are threaded through the base sheet element 103 of the outer layer 10 with a number of knitting needles 105 (FIG. 3) for forming a number of wale stitches 101 and a number of course stitches 102 on the base sheet element 103 (FIG. 4). A number of repeat stitches 104 (FIG. 4) may further be formed on the base sheet element 103 with the needles 105 or with the other needles, and engaged with the wale stitches 101 and/or the course stitches 102 and for forming the outer layer 10. As best shown in FIGS. 6–11, the cover or the outer layer 10 of the water absorbing device is preferably made of or woven by the threads that have fine hair members 14 (FIGS. 6–11) provided thereon, and/or is preferably made of a hairy base sheet element 103 (FIGS. 3–5), for forming a hairy structure or configuration. The hair members 14 and/or the hairy materials of the hairy base sheet element 103 are not shown in FIGS. 3–5, but shown in FIGS. 6–11.

Figure 5:
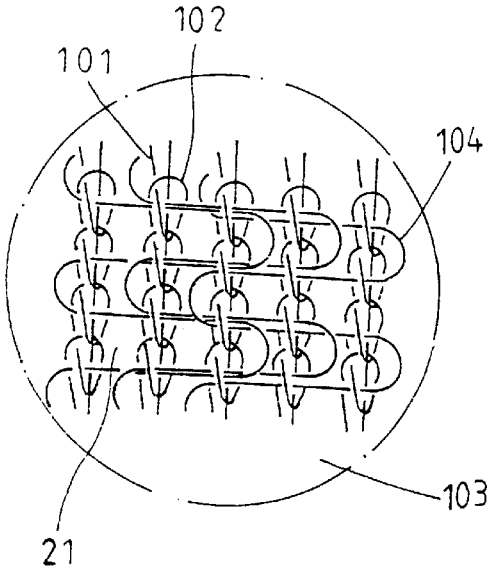
Figure 6:
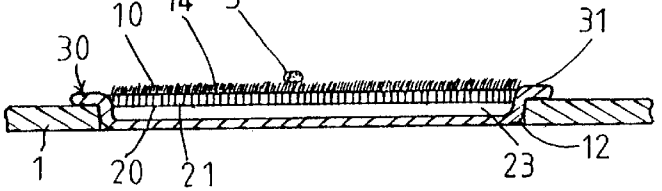
FIG. 6 is a cross sectional view taken along lines 6—6 of FIG. 1.

The intermediate layer 20 is disposed between the outer layer 10 and the bottom layer 30, and as shown in FIG. 5, also includes a number of wale stitches 101 and a number of course stitches 102 and a number of repeat stitches 104 formed on the base sheet element 103 and engaged with each other for forming the intermediate layer 20. The intermediate layer 20 may be secured to the outer layer 10 with stitches, for example, and includes a number of gaps or spaces 21 (FIG. 6) formed therein for absorbing the water and/or the blood and/or the other fluid substances generated during the surgical operations. It is preferable that a gap or a chamber 23 (FIGS. 6–8) is formed between the intermediate layer 20 and the bottom layer 30 for further receiving or containing the water and/or the blood and/or the other fluid substances generated during the surgical operations. The stitches 101, 102, 104 and the base sheet member 103 of the intermediate layer 20 may also include a number of hairy members provided thereon.

Figure 8:
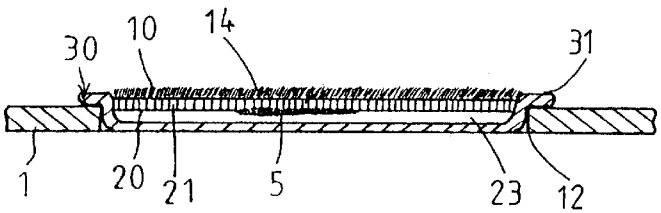
Figure 9:
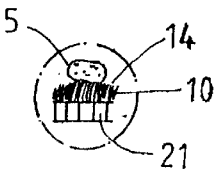
FIGS. 9, 10, 11 are enlarged partial cross sectional views of FIGS. 6, 7, 8 respectively, illustrating the operation of the cloth member.
Figure 10:
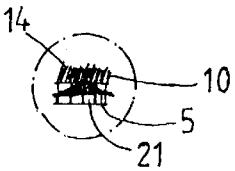
Figure 11:
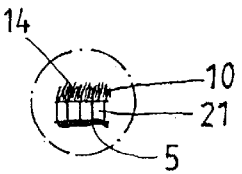

In operation, as shown in FIGS. 6–11, when the water and/or the blood and/or the other fluid substances 5 generated during the surgical operations are dropped or applied onto the outer layer 10, the hair members 14 and/or the hairy materials of the hairy base sheet element 103 of the outer layer 10 may be formed as a surfactant device for spoiling or obstructing the surface tension of the fluid substance 5 and for allowing the fluid substance 5 to be easily and quickly absorbed into the outer layer 10, and to be absorbed into and stored in the intermediate layer 20 (FIGS. 7, 10) and/or in the chamber 23 formed between the intermediate layer 20 and the bottom layer 30 (FIGS. 8, 11).

Figure 1:
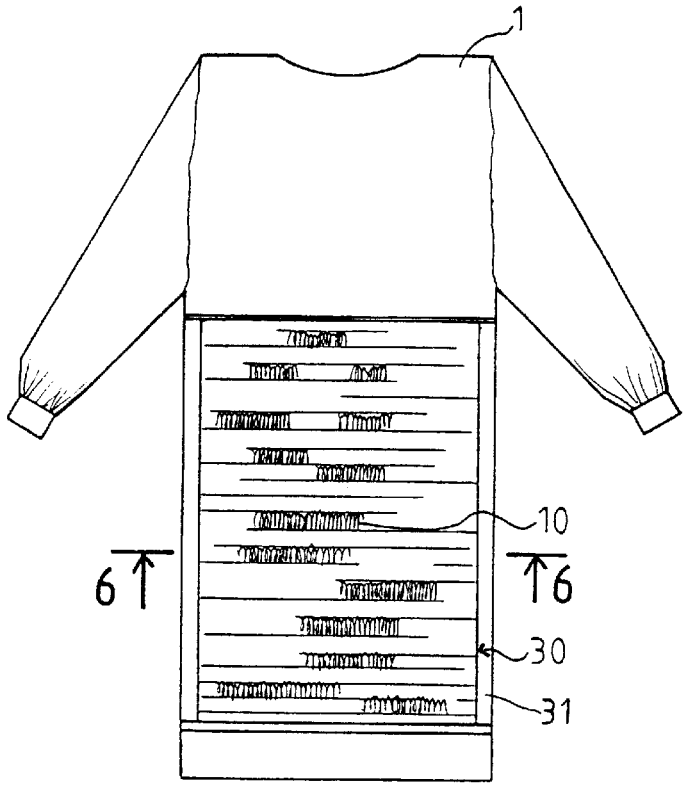
FIG. 1 is a plane view of a cloth member in accordance with the present invention.
Figure 15:
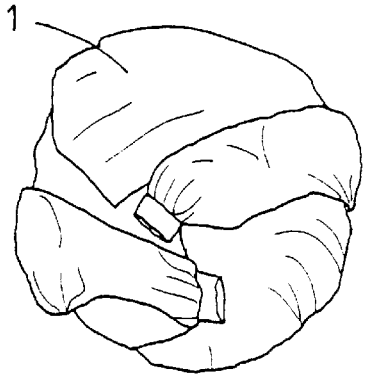
FIGS. 13, 14, 15, 16 are perspective views illustrating the operation of the cloth member.
Figure 16:
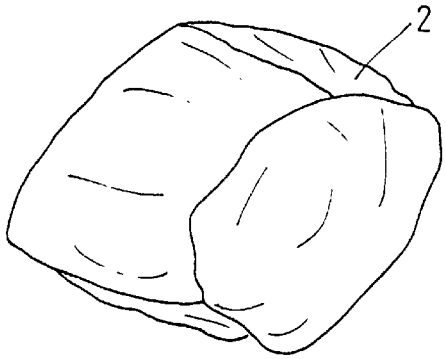
Figure 14:
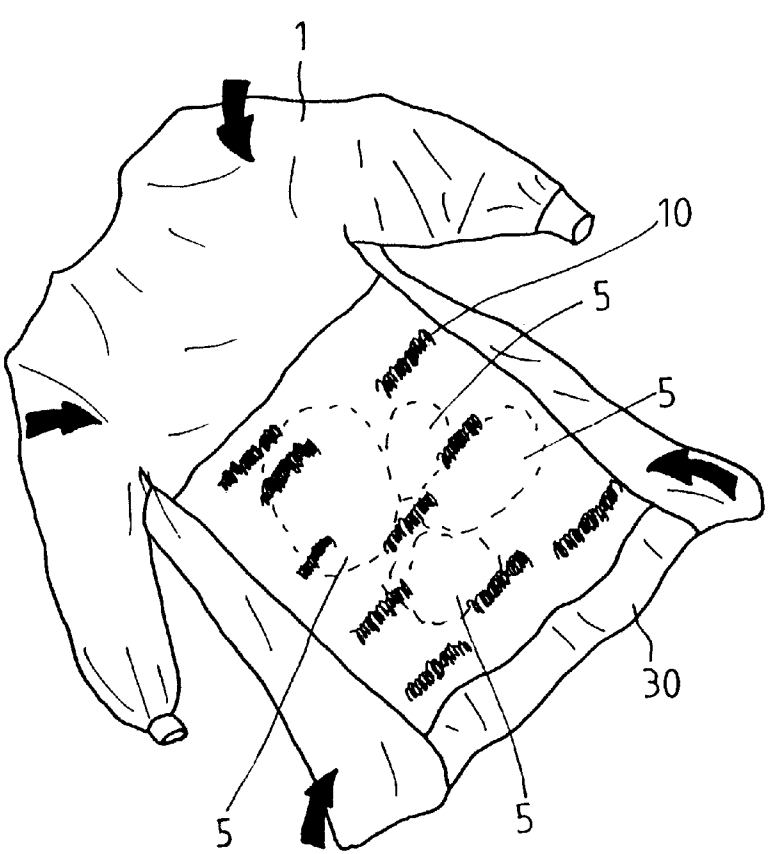
Figure 13:
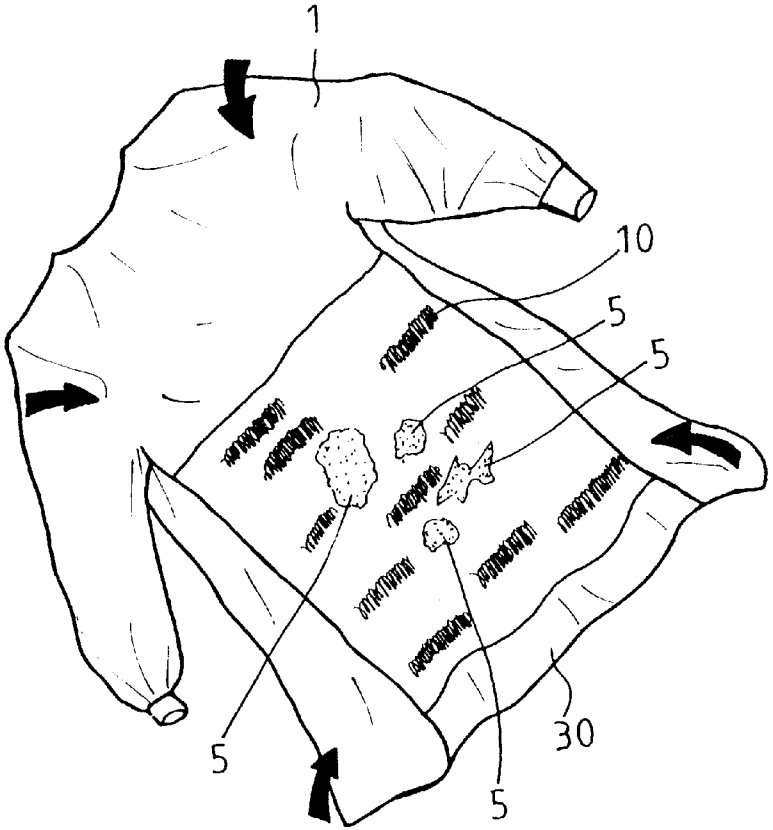

The outer layer 10 is preferably formed or knitted into a configuration having a dense or compact knitting formed in the outer portion that is distal to the intermediate layer 20, and having a loose knitting formed in the inner portion that is close to the intermediate layer 20. The water and/or the blood and/or the other fluid substances 5 that are absorbed into the outer layer 10 may be absorbed into the inner loose knitting portion of the outer layer 10 and may be diffused in the intermediate layer 20 and may be prevented from flowing out of the outer layer 10 by the dense or compact knitting outer portion of the outer layer 10. As shown in FIGS. 13 and 14, when or after the water and/or the blood and/or the other fluid substances 5 generated during the surgical operations are absorbed into the outer layer 10 and/or the intermediate layer 20 of the water absorbing device, the people or the workers, particularly the nurses may fold the corners of the base member 1 or 2 and may easily fold the cloth member into a ball-shaped configuration as shown in FIGS. 15, 16 without contacting with the water and/or the blood and/or the other fluid substances 5. The water-proof layer 30 of the water absorbing device may be used to prevent the water and/or the blood and/or the other fluid substances 5 from contacting with the doctors or the wearers who wear the cloth member of the present invention.

It is to be noted that the water and/or the blood and/or the other fluid substances 5 generated during the surgical operations may contain various kinds of dirt and/or germs or the like. The workers or the nurses for treating the cloth member, or the patients or the doctors who wear the cloth member will not be contacted with or may be prevented from contacting with the water and/or the blood and/or the other fluid substances generated during the surgical operations. The cloth member having the water absorbing device provided therein may benefit the workers and the nurses and the users a lot.

Accordingly, the cloth member in accordance with the present invention includes a water absorbing configuration for use in surgical operations and for absorbing the water and/or the blood and/or the other fluid substances generated during the surgical operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cloth member for use in surgical operations, said cloth member comprising:

a) a base member, and b) a fluid absorbing device attached onto said base member for absorbing a fluid, said fluid absorbing device including:

i) a water-proof layer attached to said base member, and including a peripheral flange engaged with and secured to said base member, ii) a cover layer attached to said water-proof layer for absorbing the fluid, and iii) at least one intermediate layer disposed between said cover layer and said water-proof layer of said fluid absorbing device, and said at least one intermediate layer including a base sheet element, and including a plurality of wale stitches and a plurality of course stitches and a plurality of repeat stitches formed on said base sheet element and engaged with each other for forming said at least one intermediate layer.

2. The cloth member according to claim 1, wherein said cover layer includes a base sheet element, and includes a plurality of wale stitches and a plurality of course stitches and a plurality of repeat stitches formed on said base sheet element and engaged with each other for forming said cover layer.

3. The cloth member according to claim 2, wherein said base sheet member of said cover layer includes a plurality of hairy members formed thereon for spoiling a surface tension of the fluid.

4. The cloth member according to claim 2, wherein said wale stitches and said course stitches and said repeat stitches of said cover layer each includes a plurality of hairy members formed thereon for spoiling a surface tension of the fluid.

5. The cloth member according to claim 1, wherein said cover layer includes at least one thread stitched thereon and includes a plurality of hairy members provided on said at least one thread for spoiling a surface tension of the fluid.

6. The cloth member according to claim 1, wherein said at least one intermediate layer is secured to said cover layer.

7. A cloth member for use in surgical operations, said cloth member comprising:

a) a base member, and b) a fluid absorbing device attached onto said base member for absorbing a fluid, said fluid absorbing device including:

i) a water-proof layer attached to said base member, ii) a cover layer attached to said water-proof layer for absorbing the fluid, and iii) at least one intermediate layer disposed between said cover layer and said water-proof layer of said fluid absorbing device, and said fluid absorbing device including a chamber formed between said at least one intermediate layer and said cover layer.

8. A cloth member for use in surgical operations, said cloth member comprising:

a) a base member including a depression formed therein, and b) a fluid absorbing device attached onto said base member for absorbing a fluid, and received in said depression of said base member, said fluid absorbing device including:

i) a water-proof layer attached to said base member, and ii) a cover layer attached to said water-proof layer for absorbing the fluid.

* * * * *